US006145979A

United States Patent [19]

Caiger et al.

[11] Patent Number: 6,145,979

[45] Date of Patent: Nov. 14, 2000

[54] INK JET PRINTER WITH APPARATUS FOR CURING INK AND METHOD

[75] Inventors: Nigel Antony Caiger, Wookey Hole; Michael Anthony Cockett, Lenham, both of United Kingdom

[73] Assignee: Coates Brothers PLC, Kent, United Kingdom

[21] Appl. No.: 09/011,164

[22] PCT Filed: Jul. 19, 1996

[86] PCT No.: PCT/GB96/01721

§ 371 Date: Jul. 15, 1998

§ 102(e) Date: Jul. 15, 1998

[87] PCT Pub. No.: WO97/04964

PCT Pub. Date: Feb. 13, 1997

[30] Foreign Application Priority Data

Aug. 2, 1995 [GB] United Kingdom ..... 9515804
Apr. 29, 1996 [GB] United Kingdom ..... 9608936

[51] Int. Cl.[7] ..... B41J 2/01
[52] U.S. Cl. ..... 347/102
[58] Field of Search ..... 347/101, 102

[56] References Cited

U.S. PATENT DOCUMENTS

| | | | |
|---|---|---|---|
| 4,340,893 | 7/1982 | Ort | 347/102 |
| 4,970,528 | 11/1990 | Beaufort et al. | 347/102 X |
| 5,041,846 | 8/1991 | Vincent et al. | 347/102 X |
| 5,130,726 | 7/1992 | Fukushima et al. | 347/102 |
| 5,220,346 | 6/1993 | Carreira . | |
| 5,732,633 | 3/1998 | Herskowits | 347/102 X |

FOREIGN PATENT DOCUMENTS

| | | | |
|---|---|---|---|
| 0284215 | 9/1988 | European Pat. Off. . | |
| 0622194 | 11/1994 | European Pat. Off. . | |
| 3417376 | 11/1984 | Germany . | |
| 4019543 | 1/1991 | Germany . | |
| 60-132767 | 7/1985 | Japan | 347/102 |
| 61-209163 | 9/1986 | Japan | 347/102 |
| 63-62738 | 3/1988 | Japan | 347/102 |
| 3-222748 | 10/1991 | Japan . | |
| 4-141425 | 5/1992 | Japan | 347/102 |
| 5-286128 | 11/1993 | Japan | 347/102 |

OTHER PUBLICATIONS

International Search Report.

*Primary Examiner*—William J. Royer
*Attorney, Agent, or Firm*—Ostrolenk, Faber, Gerb & Soffen, LLP

[57] ABSTRACT

A process and apparatus for forming an image on a moving substrate involves ink jet printing a radiation-curable ink onto the substrate with a print head. The image is cured by exposure to a radiation source. The time between printing and curing is substantially the same for all portions of the substrate.

28 Claims, 2 Drawing Sheets

INK JET PRINTER WITH APPARATUS FOR CURING INK AND METHOD

This invention is concerned with improvements in and relating to printing apparatus and processes, more especially ink jet printing processes and, particularly, such processes employing radiation-curable inks such as UV-curable inks.

Ink jet printing processes are well known and well established (see, for example "Output Hardcopy Devices", Durbeck R. C. and Sherr S., Eds Academic Press Inc., 1908, at pages 311–370). The rise of radiation-curable, especially V-curable, inks in such a process would appear highly desirable since, after appropriate curing, radiation curable inks afford a tough, durable image upon the substrate to which they are applied. This makes the process especially applicable to printing on plastics packaging where high durability is required. Therefore, it can be applied not only to conventional cellulosic substrates such as paper and board, but also to synthetic polymcric substrates.

We have found that problems can be encountered in printing a radiation-curable ink upon a substrate by an ink jet printing process and subsequently curing the substrate, bearing the uncured printed image, by exposing it to radiation in a conventional manner. Thus in accordance with usual procedures, substrates bearing uncured radiation-curable images are cured by passing them under one or more radiation sources (e.g. mercury vapour lamps in the case of UV-radiation) at a relatively high linear speed. Since ink jet printing is relatively slow, as compared with some other printing methods, the fist printed portion of a substrate may well bear an uncured image for a markedly longer period of time than the last printed portion of that substrate, before curing of the printed image. We have found that this can give rise to problems and undesirable results due, for example, to differential absorption of the ink into a porous substrate, such as a cellulosic web, or spreading or mixing of colours before curing.

In accordance with a first aspect of the present invention, there is provided a process for forming an image upon a moving substrate, the process comprising the steps of ink jet printing a radiation-curable ink onto the substrate with a print head and subsequently curing the printed image by exposure to appropriate radiation, in which the process time period between printing and curing is substantially the same for all portions of the substrate.

In accordance with a second aspect of the present invention, there is provided, an ink jet printing apparatus for printing onto a substrate with a radiation-curable ink, the apparatus comprising a print head for directing the ink onto the substrate and curing means for curing a printed image by exposure to appropriate radiation the curing means being adapted to cause the time period between printing and curing to be substantially the same for all portions of the substrate.

The process and apparatus of the present invention are particularly suitable for use in combination with a drop on demand process but, of course, may also be used in combination with other ink jet printing processes, either continuous or intermittent. In the following description, reference will be made only to UV-curable inks but it is to be understood that, where the context permits, reference to other forms of radiation-curable inks is intended.

In accordance with one particular embodiment of the invention, appropriate curing means is arranged in combination with the print head of the ink jet apparatus, travelling therewith so that images printed upon the surface of the substrate are exposed to curing radiation very shortly after having been printed upon the substrate. In such an arrangement it is very difficult with presently available UV sources, to provide a small enough radiation source connected to and travelling with the print head. In accordance with a particular embodiment of the present invention, a static fixed radiation source is employed and the curing UV radiation is supplied from that source to an irradiation head, of appropriate dimensions, connected with the radiation source by means of flexible radiation conductive means such as a fibre optic bundle or an internally reflective flexible tube.

Alternatively, UV curing radiation may be supplied from a fixed source to the radiation head by an arrangement of mirrors including a mirror upon the radiation head. If desired, unwanted forms of radiation, e.g. visible or infrared radiation, may be wholly or partially filtered out from the curing UV radiation and this has the advantage of reducing the amount of unwanted energy supplied to the substrate, thereby avoiding problems such as softening of plastic substrates or enbrittlement of cellulosic substrates.

In accordance with another embodiment of the invention the source of UV radiation is arranged not to move with the print head but, rather, takes the form of an elongate radiation source extending transversely across the substrate to be cured and adjacent the transverse path of the print head so that the subsequent rows of images formed by the print head are passed, stepwise or continually, beneath that radiation source.

In practical arrangement, it may be desirable to provide a plurality of print heads in relative close proximity in a printing station, for printing with different coloured inks to produce a multi-coloured image. In that case, each has its own dedicated radiation source.

Further advantages may be obtained if the or each curing means is arranged such that the radiation is emitted at a variable distance downstream of the or each respective print head. This adjustment can allow the printed ink droplets to effect a desired degree of spreading/fusion to enhance image quality.

It is also possible to place a second radiation source at a further distance away from the print head or print station. In this way, the two beams of radiation striking the substrate can be arranged to have different intensities, for example the beam(s) striking the substrate nearest to the print head(s) could have a relatively low intensity and the second, further away, beam could have a higher intensity. This has the further advantage that some pre-curing of the printed droplets may be affected by the first beam to provide further control of the amount of spreading/fusion and viscosity of the printed droplets, prior to final curing by the second beam.

UV-curable printing inks are well known and do not form a part of the present invention. For example, our UK patent application no. 9603667.9, unpublished at the priority date of the present invention, discloses a UV-curable ink jet composition comprising an alkoxylated or polyakoxylated acrylate monomer, a photoinitiator and a colorant. In any event, UV-curable printing inks generally comprise an ethylenically unsaturated monomer or oligomeric binder which polymerises, under the influence of UV-radiation, to form a cured resinous binder. Generally such inks also contain UV photo initiators serving to initiate polymerisation of the monomer or oligomer on exposure to UV radiation.

The principle underlying the present invention, namely arranging ink jet printing means and curing means so that the time period between printing and curing for any portion of the substrate is substantially the same, may also be applied to other curing systems such as drying or cooling systems.

The present invention will now be explained in more detail by way of the following description of non limiting embodiments and with reference to the accompanying drawing in which.

Figure 1:
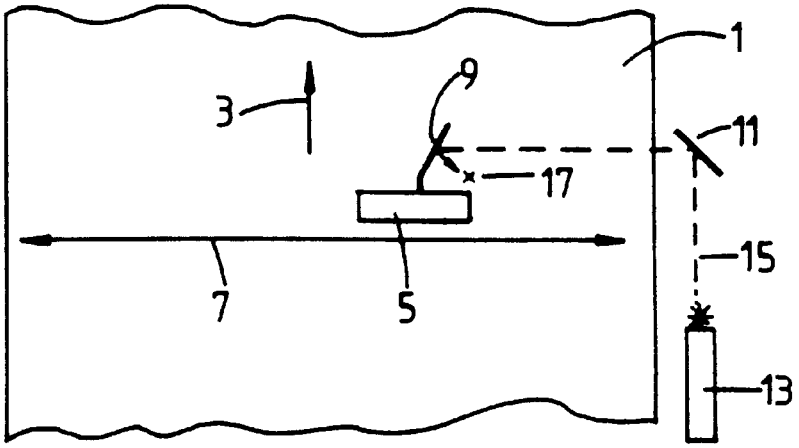
FIG. 1 shows an apparatus and process according to a first embodiment of the present invention.

Turning now to FIG. 1, there is shown a substrate 1 moving in the direction of a single-headed arrow 3. A print head 5 arranged for printing with a UV-curable ink transverses the substrate 1 as shown by the double headed arrow 7, in a direction perpendicular to the single-headed arrow 3: A first mirror 9 is fixed to the print head 5. A second mirror 11 is arranged to one side of the substrate, as is a laser 13.

In use, a radiation beam 15 from the laser 13 is reflected via the second mirror 11 and then the first mirror 9 to impinge upon the substrate at a position 17 which is at a fixed distance downstream (i.e. in the direction of travel of the substrate 1 as denoted by the single-headed arrow 3). This fixed position is maintained because the first mirror 9 is attached to the print head 5. The positions of the second mirror 11 and laser 13 are also such that the radiation beam will strike the substrate at this fixed distance downstream of the print head 5.

Figure 2:
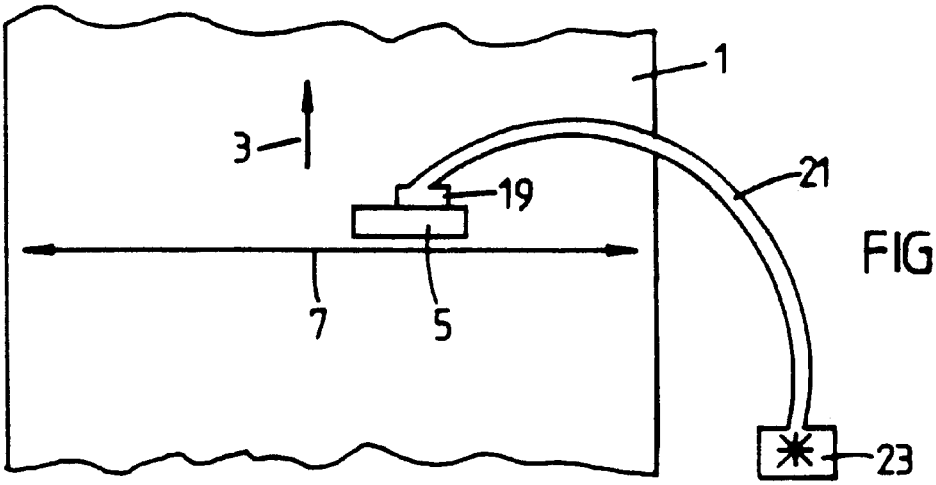
FIG. 2 shows an apparatus and process according to a second embodiment of the present invention.

Turning now to FIG. 2, instead of the first mirror 9 shown in the embodiment of FIG. 1, a radiation-emitting head 19 is attached to the print head 5. This head 19 is connected via a flexible light-pipe or optical fibre 21 to an external radiation source 23. In use, as the print head 5 traverses the width of the substrate as denoted by the double-headed arrow 7, the radiation emitted by the emitting head 19 will always be at a fixed point downstream of the print head in the direction of travel of the substrate.

Figure 3:
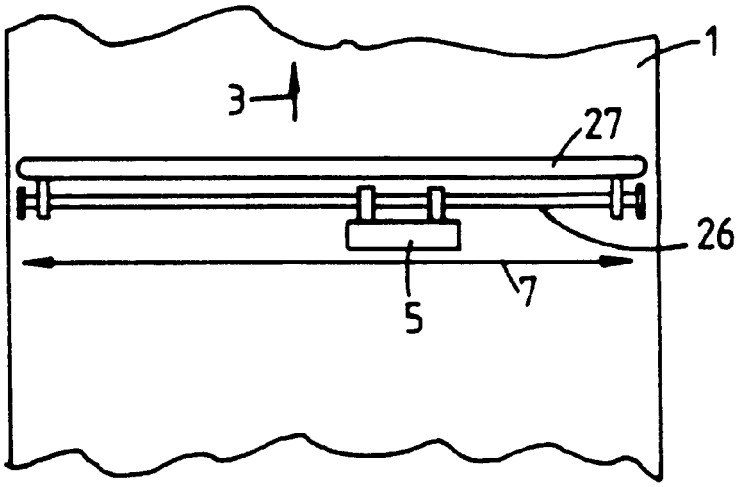
FIG. 3 shows an apparatus and process according to a third embodiment of the present invention.

A third embodiment is shown in FIG. 3 In this Case, the print head 5 traverses a rail 26 across the width of the substrate as denoted by the double-headed arrow 7. Mounted on this rail, just downstream of the print head 5 is an elongate radiation source 27 which also extends across the width of the substrate 1. Thus, curing of the ink emitted by the print head 5 will always occur at a fixed distance downstream thereof. The elongate radiation source could be, for example, an elongate fluorescent/mercury vapour tube or it could be a continuous light pipe which receives light from an external source by means (not shown) to emit light with substantially uniform intensity along its whole length.

Figure 4:
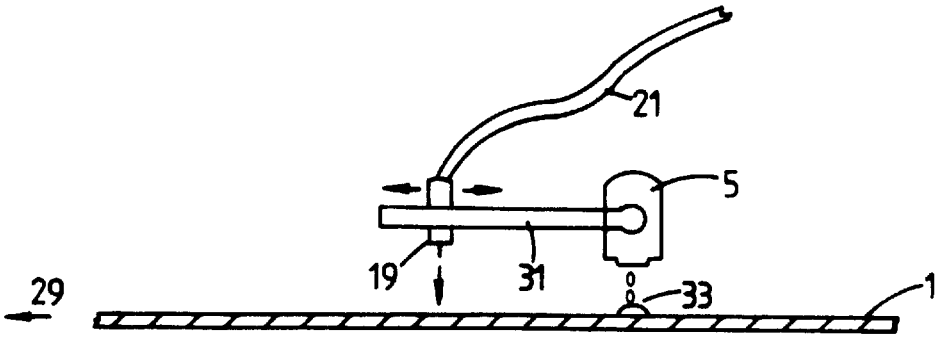
FIG. 4 shows a modification of the second embodiment of the present invention, with a variable-position radiation emitting head.

Turning now to FIG. 4, there is shown a variant of the second embodiment shown in FIG. 2, as seen from one side. Here, the substrate travels in a direction shown by the solid single-headed arrow 29. Attached to the print head 5 is a runner 31 extending downstream of the print head 5. The radiation-emitting head 19 is mounted on this runner so that it can be located in a predetermined chosen position downstream of the print head 5, to allow a predetermined air-drying/spreading time for the ink 33 after it is deposited on the substrate.

Figure 5:
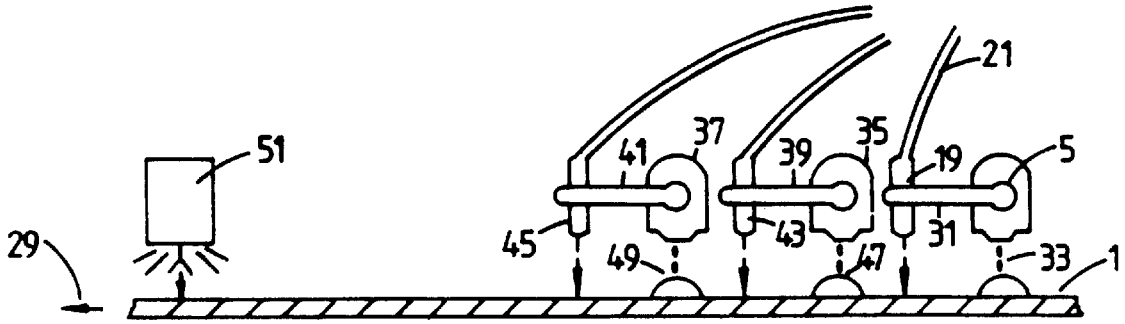
FIG. 5 shows another variant of the second embodiment of the present invention, having two mutually separated radiation-emitting heads.

A further embellishment of the arrangement shown in FIG. 4 is shown in FIG. 5. Again, the substrate 1 travels in a direction shown by the solid single-headed arrow 29. As well as the print head 5 with downstream-extending runner 31 with radiation-emitting head 19 mounted thereon, there are shown a second print head 35 and a third print head 37 respectively positioned downstream of the first print head 5. These additional print heads show a more usual situation where a plurality of heads are provided to print in respective different colours. Of course, such an arrangement could be used in the situation shown in FIG. 4 but are omitted there for clarity.

The additional print heads 35, 37 also have respective downstream-extending runners 39, 41, each of the latter supporting a respective additional radiation-emitting head 43, 45.

Just as the first print head 5 applies respective ink droplets 33 onto the substrate 1, the second and third heads 35, 37 print respective ink droplets 47, 49 at downstream positions on the substrate 1. The positions of the radiation sources 19, 43, 45 are each individually variable along their respective runners 31, 39, 41, relative to their associated respective print head 5, 35, 37.

At a greater distance downstream of the print heads 5, 35, 37 is situated another radiation source 51 extending across the substrate 1. This additional radiation source 51 is adapted to irradiate the image on the substrate 1 with a significantly higher intensity of radiation than the print head specific radiation sources 19, 43, 45.

In use, the embodiment shown in FIG. 5 allows low-intensity radiation beam to perform pre-curing of the printed droplets 33, 47, 49 at respective first positions downstream of their print heads 5, 35, 37 to semi-harden/fix the droplets, thus controlling droplet spread and merging. Then a second higher dose of radiation is emitted from the last radiation source of radiation-emitting head 51 further downstream, to provide complete curing of the printed image.

In the light of this disclosure, modifications of the described embodiment, as well as other embodiments, all within the scope of the present invention as defined by the appended claims will now become apparent to persons skilled in this art.

What is claimed is:

1. A process of forming an image upon a moving substrate, the process comprising the steps of ink jet printing a radiation curable ink onto the substrate with a print head and subsequently curing the image by exposure to appropriate radiation, in which a process time period between printing curing is substantially the same for all portions of the substrate, wherein first curing means is provided to direct radiation at the substrate from a first position at a predetermined distance from the print head in the direction of movement of the substrate, and wherein the first curing means is adjustable so that the predetermined distance may be varied.

2. The process according to claim 1, wherein second curing means is provided to direct further radiation at the substrate from a second position at a different predetermined distance from the print head in the direction of movement of the substrate.

3.The process according to claim 2, wherein the second curing means provides a higher intensity of radiation to impinge upon the image than that produced by the first curing means.

4. The process according to claim 3, wherein one or more further print heads are provided, each with a respective dedicated curing means at a predetermined distance therefrom, for enabling printing with a plurality of inks of different colours and each of the dedicated curing means provides a lower intensity of radiation than the second curing means.

5. The process according claim 2, wherein the second curing means has the same form as the first curing means.

6. The process according to claim 1, wherein the first curing means is arranged in combination with the print head for travelling therewith.

7. The process according to claim 6, wherein the first curing means comprises an irradiation head connected to a radiation source by means of a flexible radiation conductive means.

8. The process according to claim 6, wherein the first curing means comprises a mirror attached to the print head for directing the radiation onto the substrate, a radiation source being provided in a fixed position so as to transmit radiation to the mirror.

9. The process according to claim 8, wherein the first curing means communicates with at least one further mirror for defining an optical path between the radiation source and the mirror attached to the print head.

10. The process according to claim 8, wherein the radiation source comprises a laser.

11. The process according to claim 1, wherein the first curing means comprises an elongate radiation source extending transversely across the substrate and adjacent the transverse path of the print head so that subsequent rows of images formed by the print head are cured by radiation from the radiation source.

12. The process according to claim 1, wherein the radiation curable ink (33,47,49) is a UV-curable ink.

13. An ink jet printing apparatus for printing onto a substrate with a radiation curable ink, the apparatus comprising a print head for directing the ink onto the substrate and curing means for curing a printed image by exposure to appropriate radiation, the curing means being adapted to cause a time period between printing and curing to be substantially the same for all portions of the substrate, wherein the curing means comprises first curing means for directing radiation at the substrate from a first position at a predetermined distance from the print head in the direction of movement of the substrate, the first curing means being adjustable so that the predetermined distance may be varied.

14. The apparatus according to claim 13, further comprising second curing means for directing further radiation at the substrate from a second position at a different predetermined distance from the print head in the direction of movement of the substrate.

15. The apparatus according to claim 14, wherein the second curing means is adapted to provide a higher intensity of radiation to impinge upon the printed image than that produced by the first curing means.

16. The apparatus according to claim 15, further comprising one or more further print heads, each with a respective dedicated curing means at a predetermined distance therefrom for enabling printing with a plurality of inks of different colours wherein each of the dedicated curing means is adapted to provide a lower intensity of radiation than the second curing means.

17. The apparatus according to claim 14, wherein the second curing means has the same form as the first curing means.

18. The apparatus according to claim 15, wherein the first curing means is arranged in combination with the print head for traveling therewith.

19. The apparatus according to claim 18, wherein the first curing means comprises an irradiation head connected to a radiation source by means of a flexible radiation conductive means.

20. The apparatus according to claim 19, wherein the first curing means comprises a mirror attached to the print head for directing the radiation onto the substrate, a radiation source being provided in a fixed position so as to transmit radiation to the mirror.

21. The apparatus according to claim 20, wherein the first curing means communicates with at least one further mirror for defining an optical path between the radiation source and the mirror attached to the print head.

22. The apparatus according to claim 21, wherein the radiation source comprises a laser.

23. The apparatus according to claim 13, wherein the first curing means comprises an elongate radiation source extending traversely across the substrate path and adjacent to the transfer path of the print head so that subsequent rows of images formed by the print head are cured by radiation from the radiation source.

24. The apparatus according to claim 13, further comprises a supply of UV-curable ink.

25. A process of forming an image upon a moving substrate, the process comprising the steps of ink jet printing a radiation curable ink onto the substrate with a print head and subsequently curing the image by exposure to appropriate radiation, in which a process time period between printing curing is substantially the same for all portions of the substrate, wherein first and second curing means are provided to direct radiation at the substrate from a respective first position and a second position at different predetermined distances from the print head in the direction of movement of the substrate, and wherein the first and second curing means are of the same form.

26. The process according to claim 25, wherein the first curing means is adjustable so that the predetermined distance may be varied.

27. The process according to claim 25, wherein one or more further print heads are provided, each with a respective dedicated curing means at a predetermined distance therefrom, for enabling printing with a plurality of inks of different colours and each of the dedicated curing means provides a lower intensity of radiation than the second curing means.

28. The process according to claim 25, wherein the first curing means is arranged in combination with the print head for traveling therewith.

* * * * *